US005810270A

United States Patent [19]

Bäcker et al.

[11] Patent Number: 5,810,270

[45] Date of Patent: Sep. 22, 1998

[54] METHOD AND DEVICE FOR CONTINUOUS LOSS FREE BOBBIN CHANGE

[75] Inventors: Wolfgang Bäcker, Pulheim; Holger Drews, Neuss; Josef Jelinski, Pulheim, all of Germany

[73] Assignee: Bayer Aktiengesellschaft, Leverkusen, Germany

[21] Appl. No.: 795,296

[22] Filed: Feb. 4, 1997

Related U.S. Application Data

[63] Continuation of Ser. No. 429,982, Apr. 27, 1995, abandoned.

[30] Foreign Application Priority Data

May 4, 1994 [DE] Germany ..... 44 15 653.7

[51] Int. Cl.[6] ..... B65H 54/00

[52] U.S. Cl. ..... 242/18 A; 242/18 PW; 242/35.5 T; 242/125.1

[58] Field of Search ..... 242/18 PW, 35.5 T, 242/18 A, 25 A, 125.1

[56] References Cited

U.S. PATENT DOCUMENTS

| | | | |
|---|---|---|---|
| 3,075,715 | 1/1963 | Hensen et al. | 242/18 PW |
| 3,275,252 | 9/1966 | Bolger | 242/18 PW |
| 3,342,428 | 9/1967 | Smiley | 242/18 A |
| 3,920,193 | 11/1975 | Gujer et al. | 242/18 A |
| 4,033,519 | 7/1977 | Abe et al. . | |
| 4,283,019 | 8/1981 | Gujer | 242/18 A |

FOREIGN PATENT DOCUMENTS

| | | |
|---|---|---|
| 359453 | 3/1990 | European Pat. Off. . |
| 2524415 | 12/1975 | Germany . |

*Primary Examiner*—William Stryjewski

*Attorney, Agent, or Firm*—Sprung Kramer, Schaefer & Briscoe

[57] ABSTRACT

Method and device for winding continuous threads or yarns to produce yarn bobbins having thread reserves, wherein the bobbins are automatically changed, without the need for a catch slot, to achieve automatic, loss-free and highly reliable changing of full bobbins with empty bobbins, and the full bobbins include a thread reserve lap which is easily accessible on the bobbin edge and having a thread which runs from the thread reserve into the bobbin.

11 Claims, 10 Drawing Sheets

METHOD AND DEVICE FOR CONTINUOUS LOSS FREE BOBBIN CHANGE

This application is a continuation of application Ser. No. 08/429,982, filed on Apr. 27, 1995, now abandoned.

BACKGROUND OF THE INVENTION

The invention concerns a method and a device for winding continuous threads or yarns with continuous bobbin change for the purpose of producing yarn bobbins with a thread reserve which is appropriate for operation with the use of an automatically changing winder which is also suitable for smooth bobbins and sensitive continuous filament yarns. The method is characterized by a loss-free bobbin change, high change reliability and the possibility of the use of simple cylindrical bobbins with the formation of a thread reserve which is appropriate for operation.

Thread winders are known in a very great variety of forms. The document DE-OS 25 24 415 describes an automatic winder for yarns which allows the formation of a thread reserve. In this winder, two bobbin holders are mounted opposite each other on a plate which is capable of rotation around its centre. Each bobbin holder can be driven by a motor. Once the full bobbin, which is kept in motion by a driving roller, has attained its required weight the motors of the bobbin holder are started, the driving roller is lifted off and the plate is rotated contrary to the direction of rotation of the bobbin holder. Meanwhile, the thread which is being fed from the feed mechanism is lifted out of the traversing thread guide by a guide element and moved to the edge of the bobbin, into the thread reserve track. Between the full bobbin and the empty bobbin, a guide element must keep the thread within the wound area of the full bobbin in order to prevent loss of speed due to the thread slipping into the smaller diameter of the edge of the bobbin. In the area of the thread reserve the bobbin is equipped with a catch slot which clamps the thread and breaks the thread between the discharging bobbin and the empty bobbin. Following formation of the thread reserve, the thread is guided back into the traversing area and taken up by the traversing thread guide.

The automatic winder with a thread reserve device described in DE-OS 25 24 415 is designed for the use of yarn bobbins with a catch slot. These bobbins have certain disadvantages compared with the smooth bobbins. Their production is more complicated, they can be used only once due to the accumulation of dirt in the catch slot and following use are difficult to reutilize.

A similar winder which operates without the formation of a thread reserve is described in EP-A 0 359 453. This winder is used specially for elastane and can also operate with a bobbin without a catch slot. Following rotation of the revolver in the direction of rotation of the bobbin, the full bobbin holder is braked, the thread between the full and empty bobbins loses tension, adheres to the empty bobbin and is caught by the latter. By this means a tension is recreated until the connection is broken when the breakage limit is exceeded.

The automatic winder according to EP-A 0 359 453 described above allows a certain change reliability to be achieved in the winding of sensitive filament yarns on to smooth bobbins but it does not allow the formation of a thread reserve appropriate for operation.

The thread reserve according to DE-OS 25 24 415 is not transferable to the winder according to EP-A 359 453 since there is a danger of sensitive yarns feeding on to the driving roller due to the losses of tension caused by the friction on the guide element between the full bobbin and the empty bobbin. There is therefore a lack of bobbin change reliability.

A thread reserve which is appropriate for operation is also characterized by simplicity of handling. This is achieved when the thread reserve lap is easily accessible on the bobbin edge outside the yarn package and a thread runs from the thread reserve into the bobbin. In the case of the automatic winder described in EP-A 0 359 453, a non-fixed thread end of a non-defined length is produced when the connection between the full bobbin and the empty bobbin is broken. Where a conventional thread reserve is used, this thread is frequently fixed into the bobbin. Rapid allocation of the correct connection between the thread reserve lap and the bobbin is no longer possible.

The object of the invention is to achieve reliable winding of sensitive filament yarns using bobbins without a catch slot, to achieve automatic, loss-free and highly reliable changing of the full bobbin for an empty bobbin and to form at the start of the winding cycle a thread reserve which is appropriate for operation according to the criterion stated above. In particular, the absence of additional guide elements between the full bobbin and the empty bobbin is intended to increase the change reliability.

SUMMARY OF THE INVENTION

The object is achieved according to the invention in that during the change from the full bobbin to the empty bobbin the thread is held in the winding area and, following transfer to the empty bobbin, a small false lap is first built up in this area. The delivered thread is then moved, by means of a guide element located in front of the driving roller, into the area of the thread reserve track. The interfering false lap in the middle area of the bobbin is then likewise moved by pneumatic or mechanical means into the area of the thread reserve, the broken end being fixed within the false lap. Following formation of the thread reserve, the delivered thread is again taken up by the traversing thread guide and build-up of the lap is commenced.

The subject-matter of the invention is a method for winding continuous threads or yarns on to bobbins, with continuous bobbin change through the delivery and winding of the thread on to a bobbin core which is driven by a roller, with traversing of the thread along the axis of the bobbin core, separation of the full bobbin from the driving roller with driving of the full bobbin being taken over by a separate drive and further winding of the yarn in the middle area of the full bobbin, inward rotation of a separately driven empty bobbin until contact is made with the drive roller and thread, braking of the full bobbin, take-up of the running thread by the empty bobbin and breakage of the thread between the empty bobbin and the full bobbin, formation of a false lap in the middle area of the empty bobbin, displacement of the position of the delivered thread to the edge area of the empty bobbin for the purpose of forming a thread reserve outside the traversing area, displacement of the formed false lap into the area of the thread reserve, return of the delivered thread to the traversing unit for the purpose of forming the bobbin core and changing the full bobbin for an empty bobbin.

By comparison with the known methods for automatic bobbin change in the winding of sensitive yarn, the method according to the invention advantageously increases the yield of full bobbins. Due to its lesser susceptibility to faults, it requires less operator control, simple bobbins without catch devices or catch slots can be used and the built-up thread reserve can be used for each bobbin.

BRIEF DESCRIPTION OF THE DRAWINGS

The invention is described below in greater detail with reference to the figures, as follows.

DESCRIPTION OF THE PREFERRED EMBODIMENTS

Figure 1:
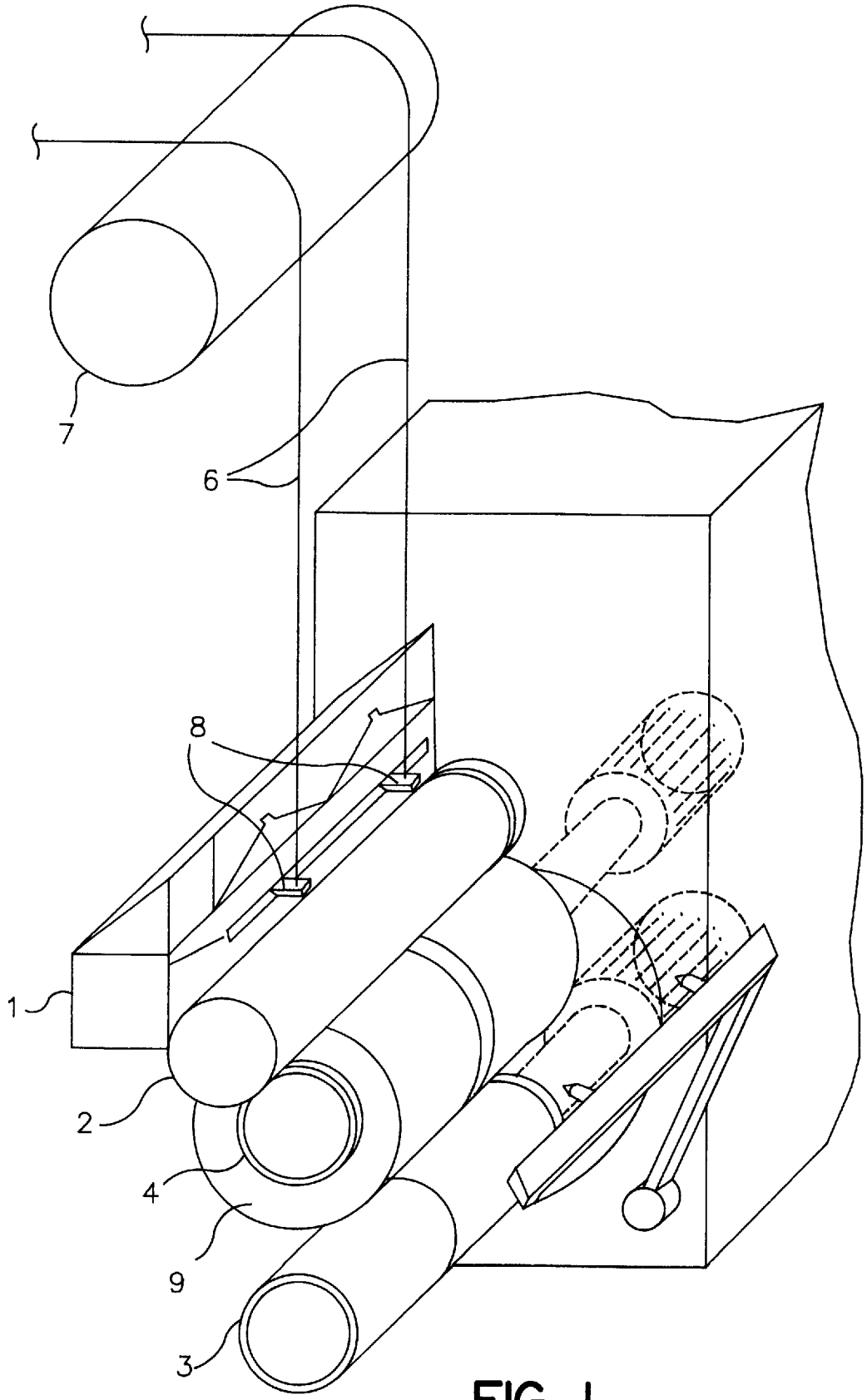
FIG. 1 shows a winder according to the invention during build-up of the bobbin.
Figure 2:
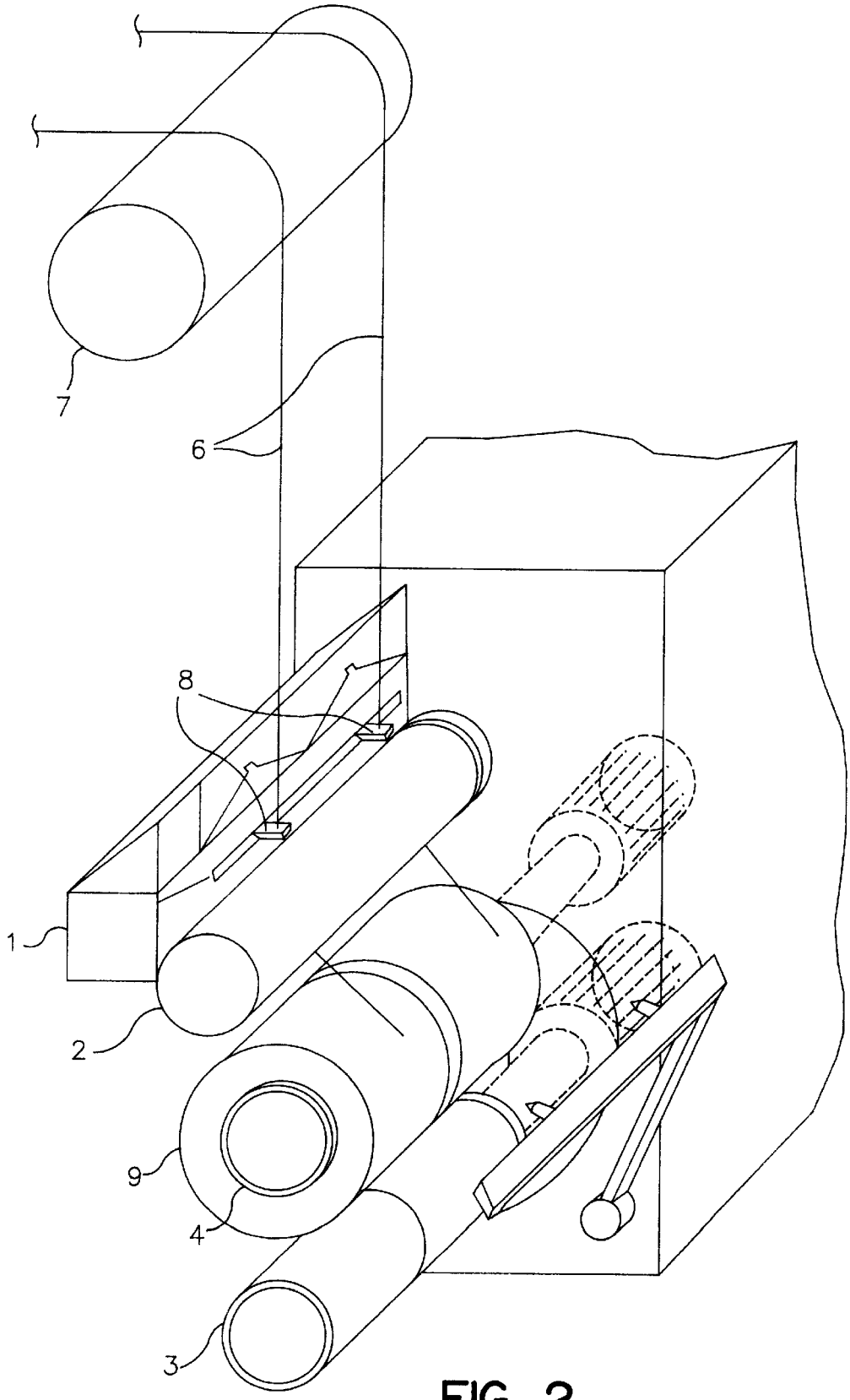
FIG. 2 is a representation of the winder during bobbin change.
Figure 3:
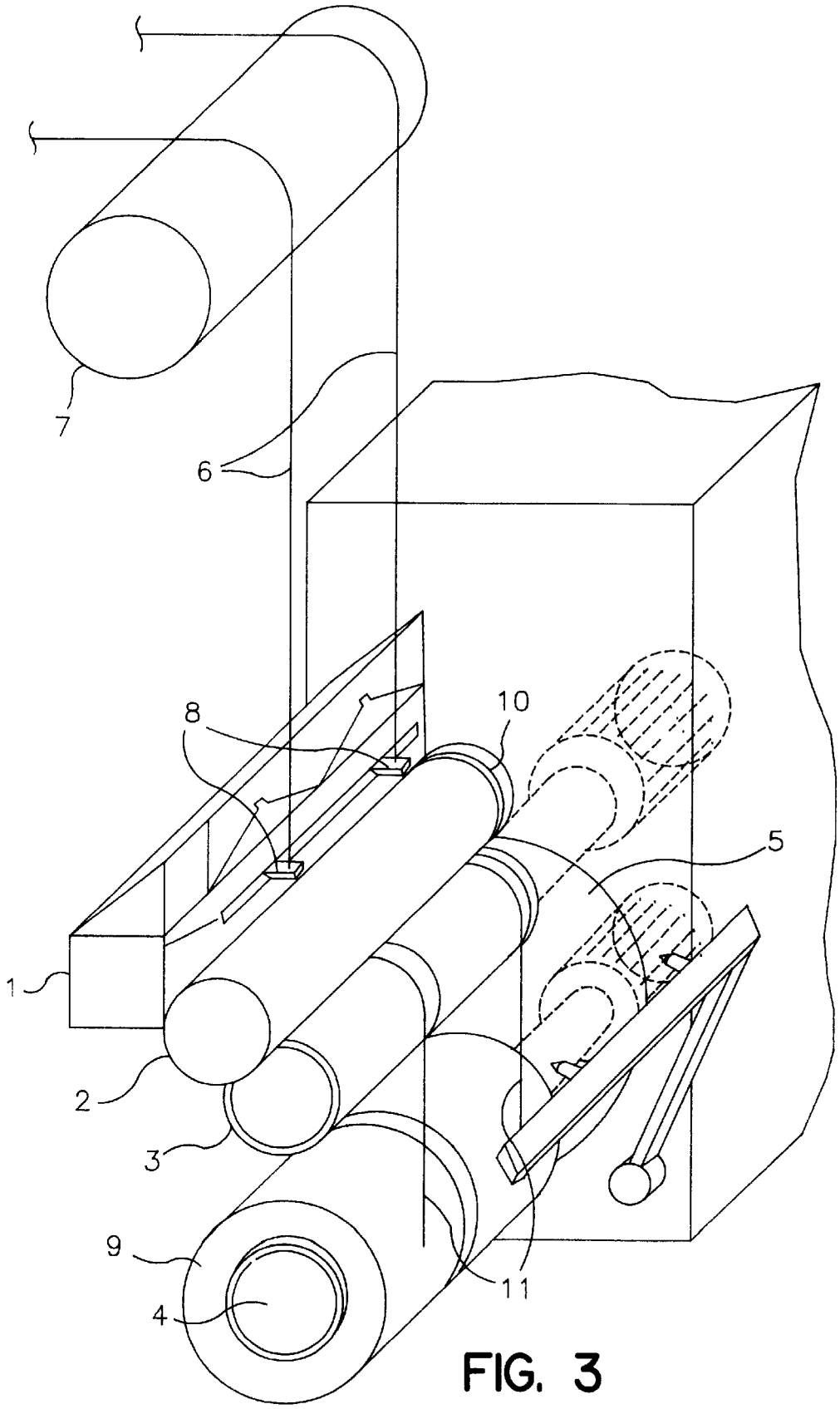
FIG. 3 is a representation of the bobbin following completion of bobbin change.
Figure 4:
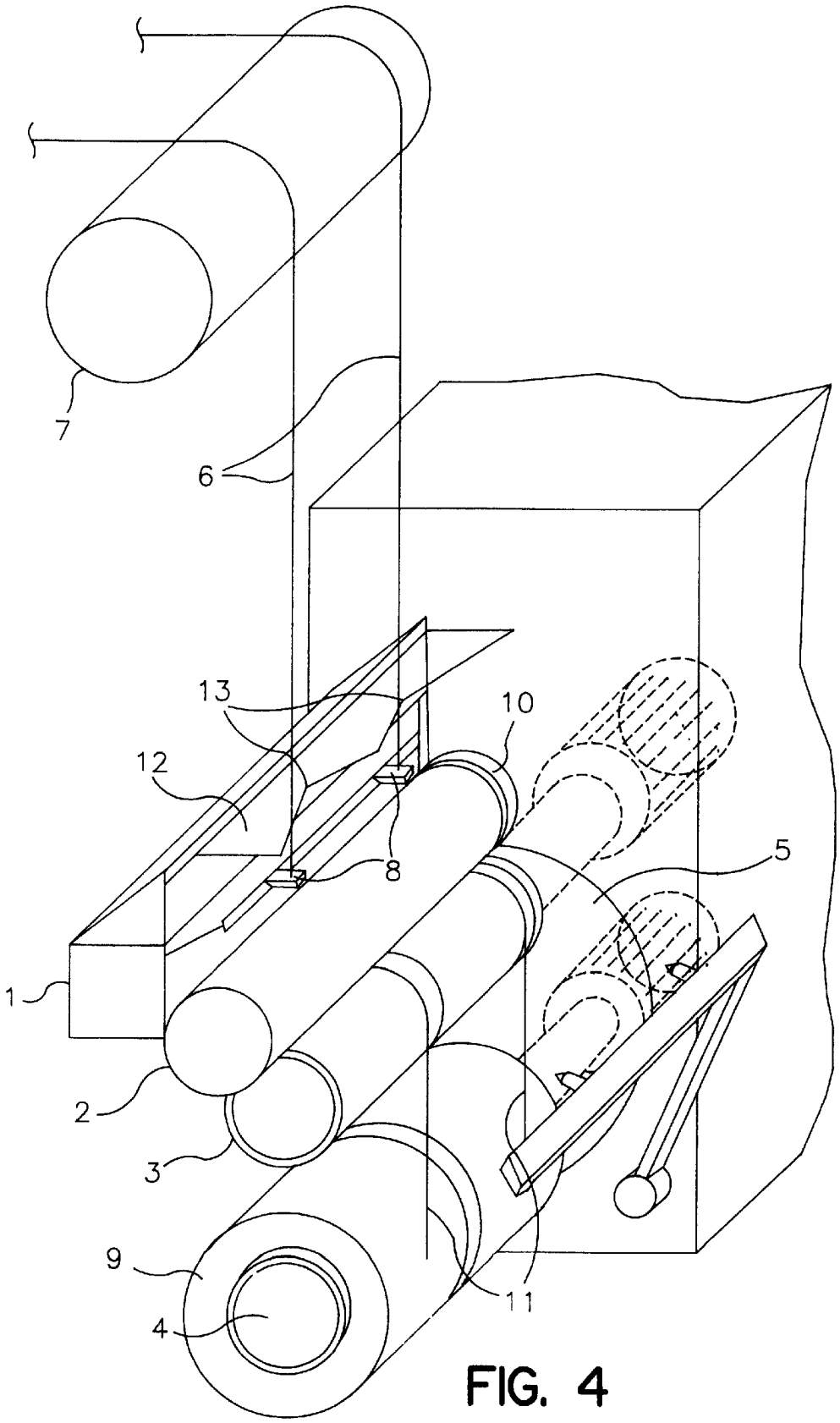
FIG. 4 shows the positioning of the thread in the breaking-off state.
Figure 5:
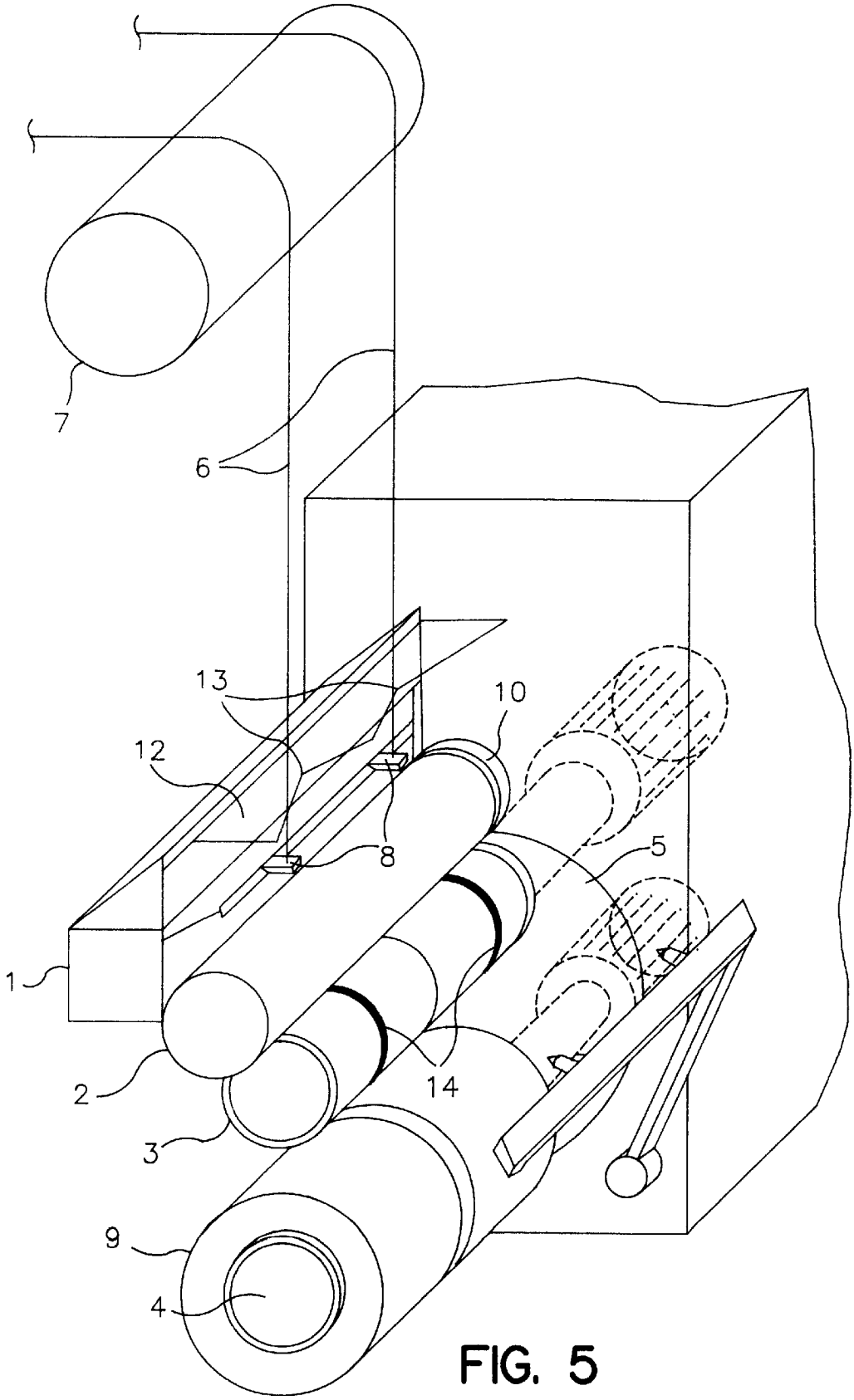
FIG. 5 shows the separation of the thread connection between the full bobbin and the empty bobbin.
Figure 6:
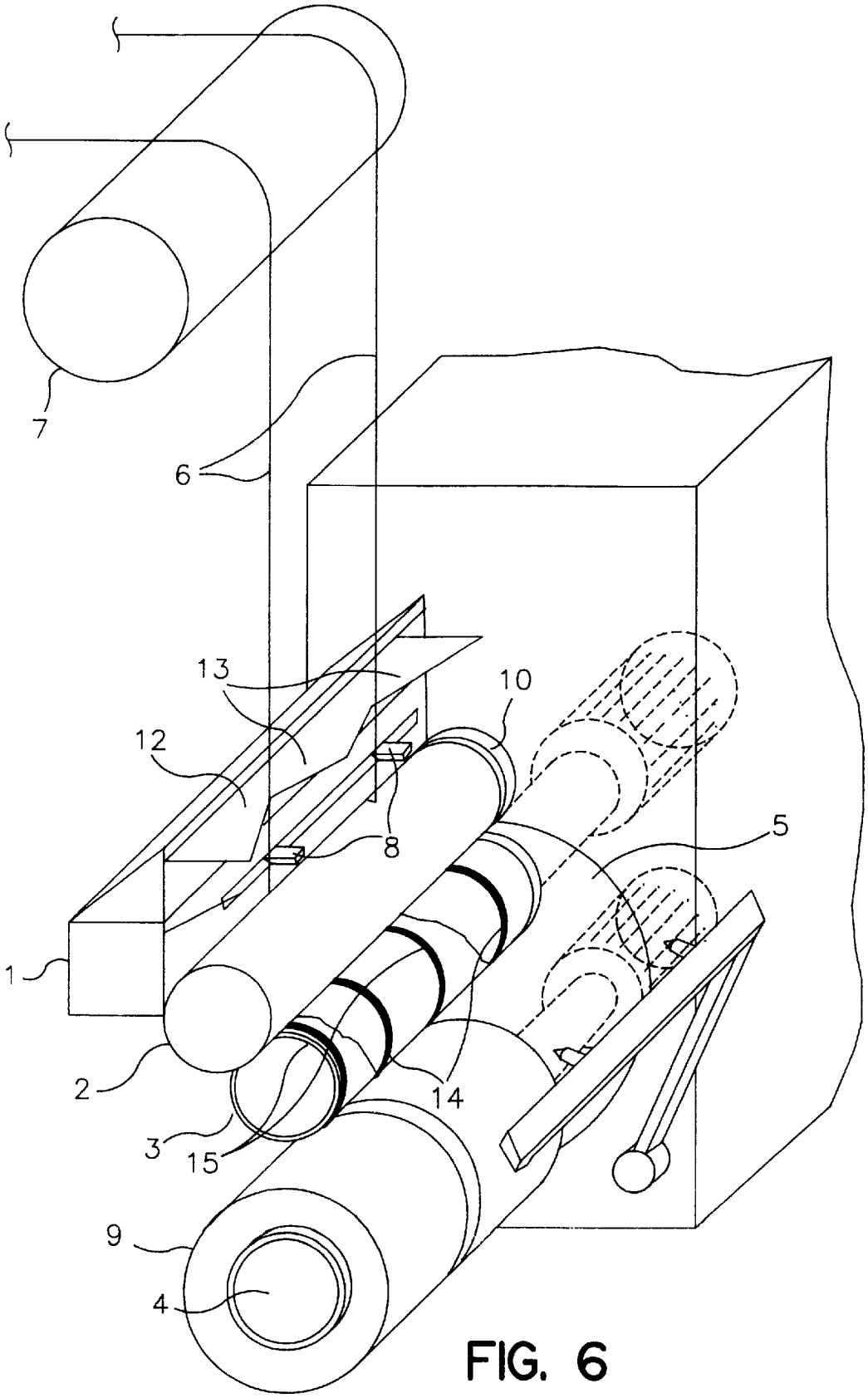
FIG. 6 shows the positioning of the thread delivered from the feed mechanism to the thread reserve bobbin.
Figure 7:
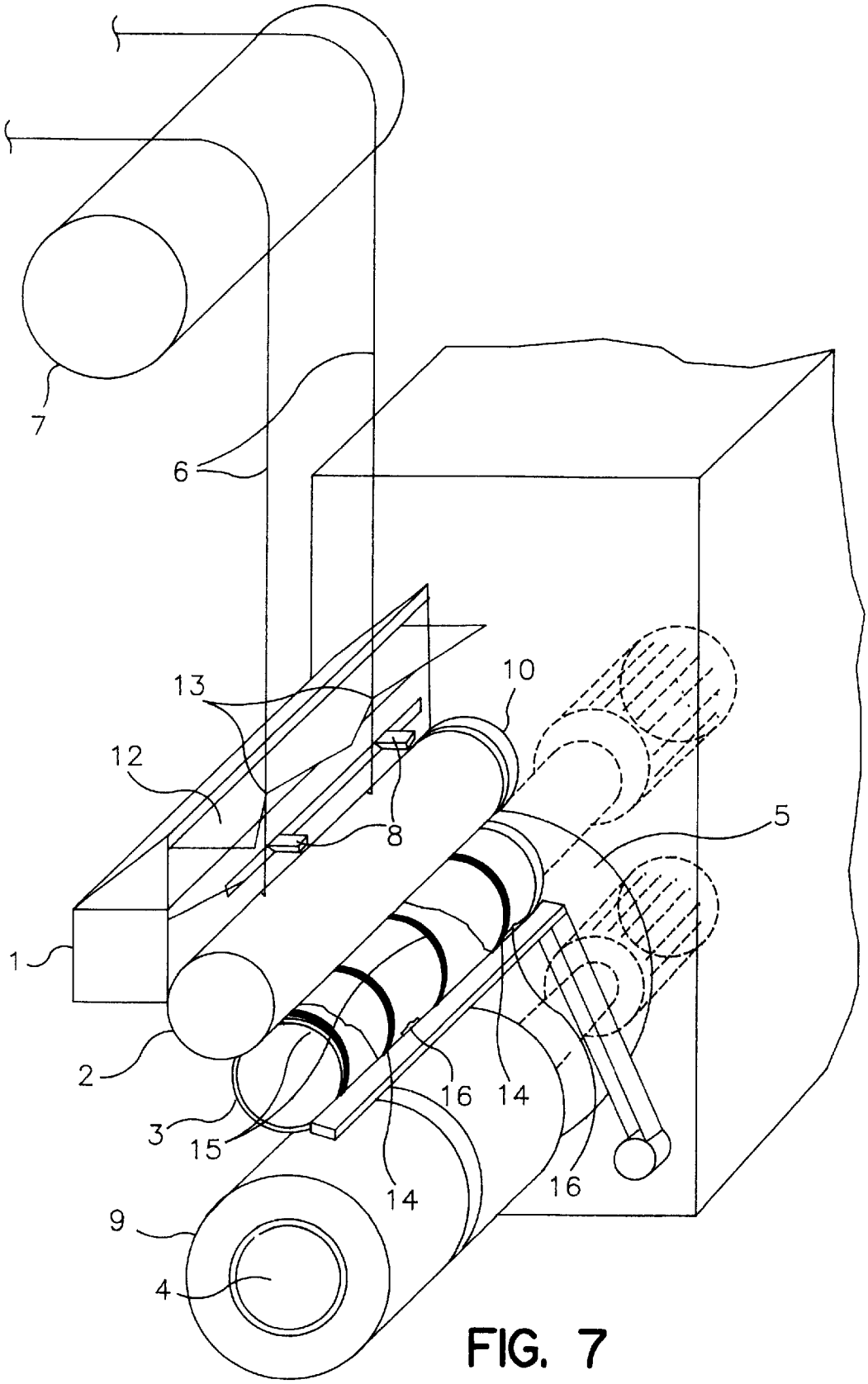
FIG. 7 shows the positioning of the guide nozzles.
Figure 8:
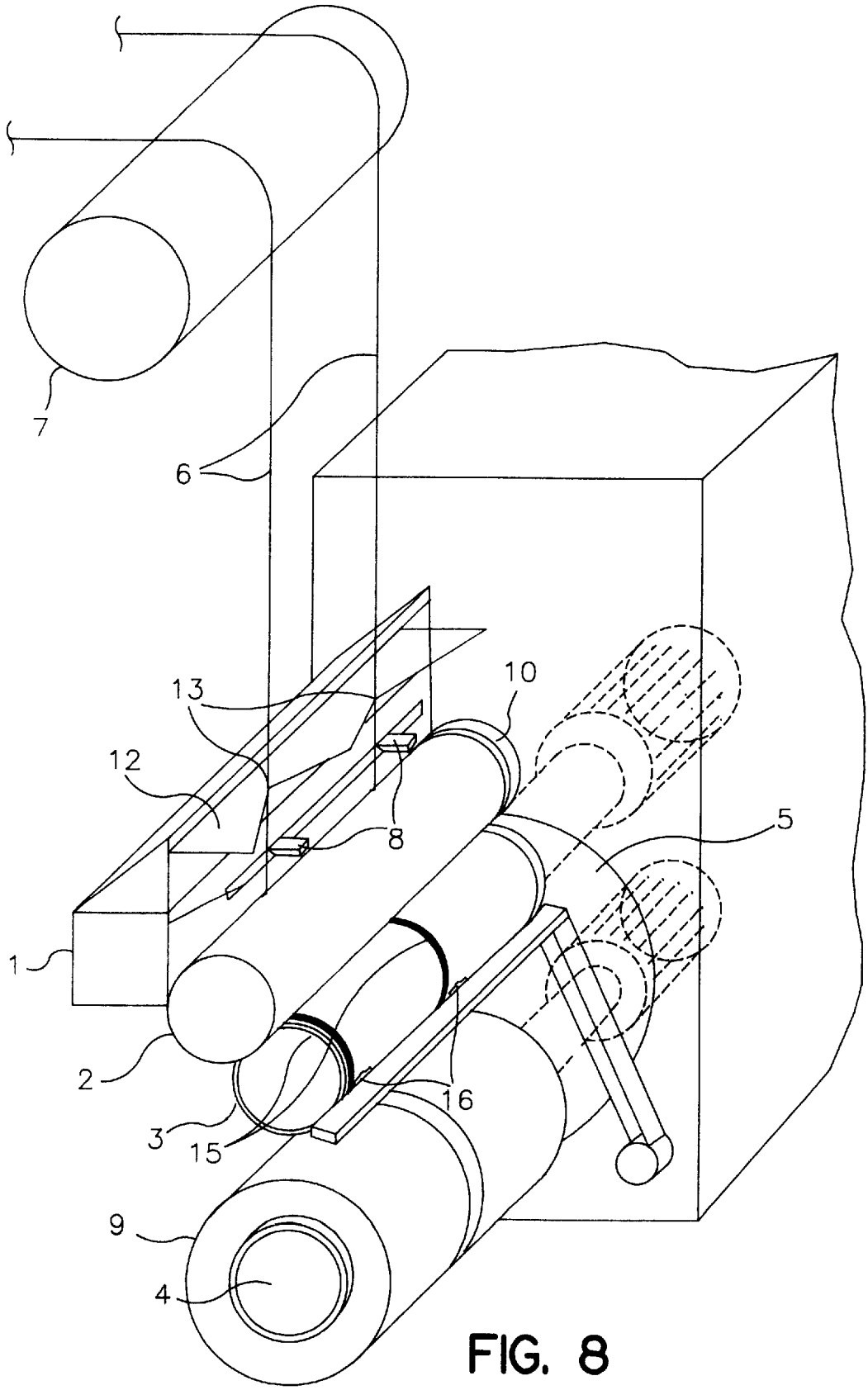
FIG. 8 shows the displacement of the false lap from the centre of the bobbin to the thread reserve track.
Figure 9:
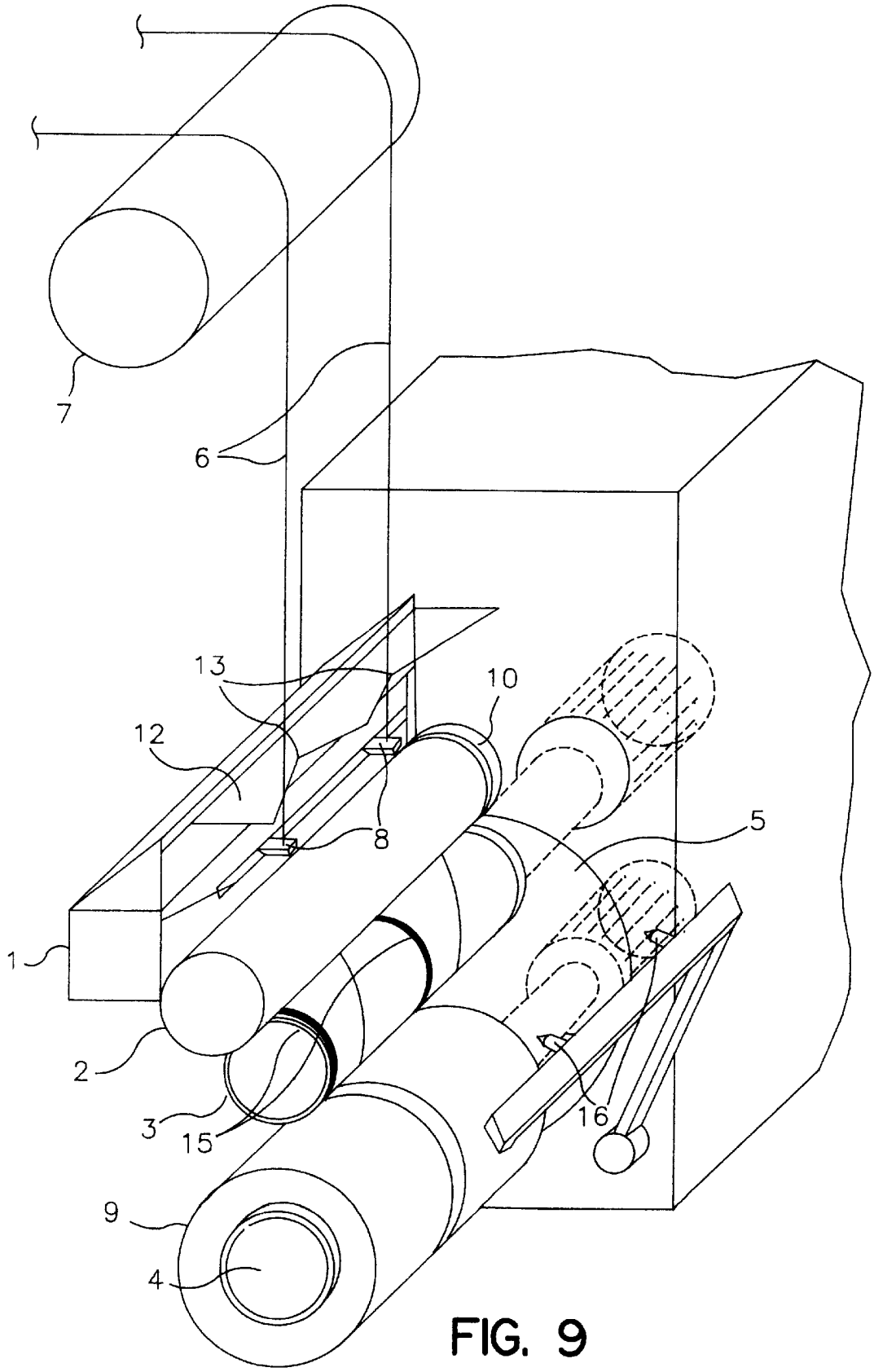
FIGS. 9 and 10 show the transition from the formation of the thread reserve to the normal winding process.
Figure 10:
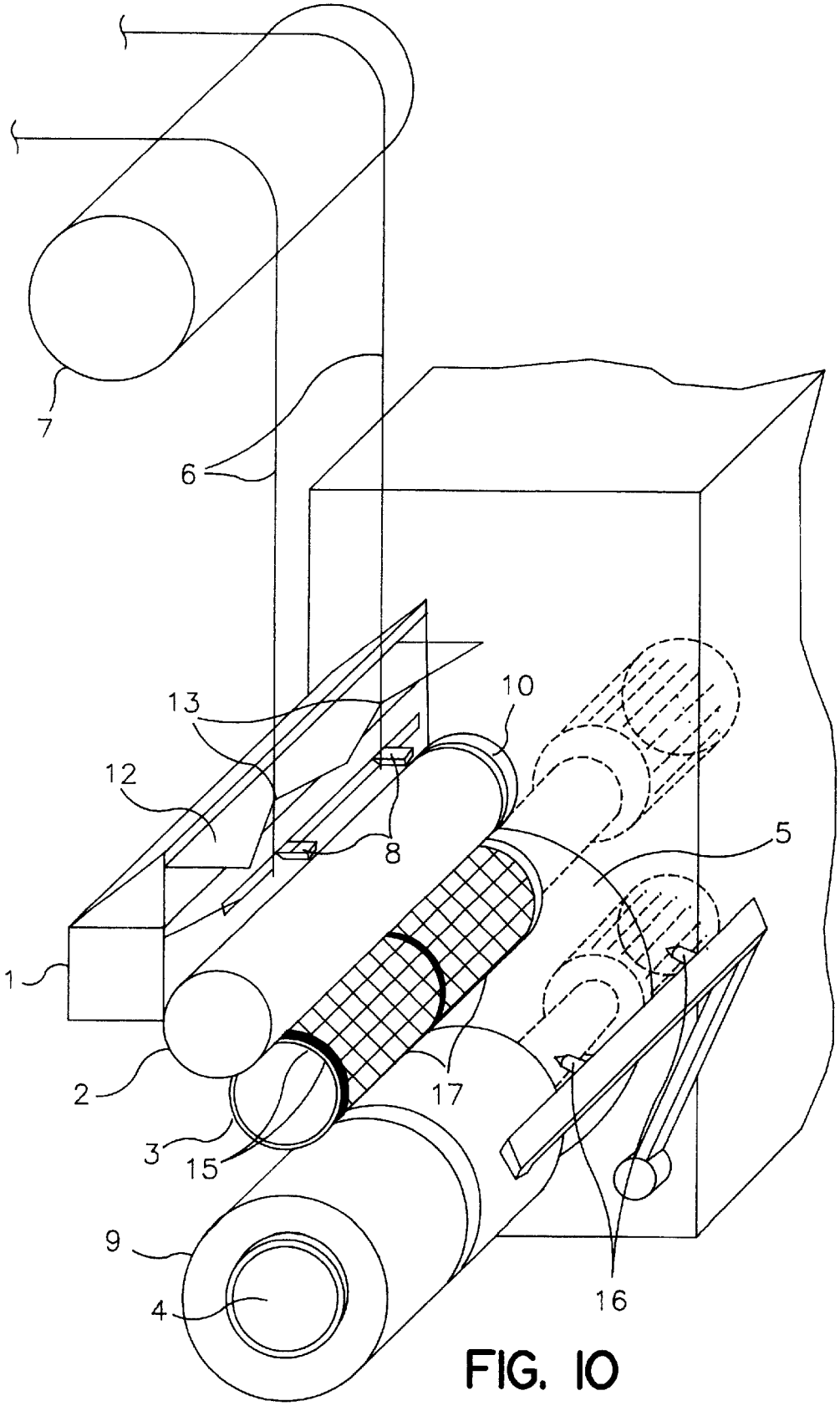

FIG. 1 shows a winder operating by the method according to the invention during normal build-up of the bobbin. The winder possesses, in particular, frequency-controlled motors for driving the traversing unit 1, the driving roller 2 and the bobbin holders 3, 4 and a geared motor for driving the revolver 5. This design shows one bobbin unit with two bobbin cores arranged in series. It is possible, in a variation of the device, for further bobbin cores to be wound in parallel with the use of axially extended mountings. During the build-up of the bobbin, the thread 6 is delivered from a feed mechanism 7 via a traversing thread guide 8 to the bobbin 9, located within the structure, which is driven by the driving roller 2. The change is initiated at the end of the running period of the bobbin 9. At the start of the bobbin change, the drives of the bobbin holder 3, fitted with empty bobbins 18, and the drive of the bobbin holder 4, holding full bobbins 9, are started. The driving roller 2 is lifted away from the full bobbins 9 (see FIG. 2). A 180° rotation of the revolver 5, in which are mounted the bobbin holders 3, 4, causes the bobbin holders to change places. Following completion of the bobbin change, the driving roller 2 is lowered on to the bobbin holder 3 fitted with empty bobbins (see FIG. 3) and drives this bobbin holder. It does not come into contact with the bobbins 18, but is held at a short distance by a stop ring 10. In this stage; the thread (6) runs over the empty bobbin 18. Since, however, the material continues to be wound on to the full bobbin 9 a thread connection is formed between the empty bobbin and the full bobbin. At this point, if not sooner, the delivered thread 6 is lifted out of the traversing thread guide 8 by means of a sliding or swivelling guide plate 12 (see FIG. 4). The plate 12 guides the thread 6 so that it runs on a narrow path within the winding area on to the bobbins. The plate has a number of recesses 13, corresponding to the number of threads, the initial aperture of which is somewhat larger than the traversing width, so that the thread 6 is reliably caught. The recess becomes narrower towards the end in order to achieve reliable guidance of the thread on the narrow path. FIG. 5 shows the separation of the thread connection between the full bobbin and the empty bobbin. The bobbin holder 4 with the full bobbins 9 is braked. The difference in speed between the feed mechanism 7 and the full bobbin 9 produced by the braking causes more thread material to be delivered to the empty bobbin 18 than is taken off by the full bobbin. The excess is wound on to the empty bobbin 18 and exerts a tensile force on the connection 11 between the empty bobbin and the full bobbin. When the tensile force exceeds the breakage limit the connection is broken and the thread 6 winds exclusively on to the empty bobbin 18, forming a false lap 14 in the middle area of the bobbin. The bobbin holder drives are then switched off. Following breakage of the threads, the guide plate 12 is moved parallel to the bobbin holder so that the delivered thread 6 is wound on to the empty bobbin in the area of the thread reserve track 15. FIGS. 7 and 8 show the displacement of the false lap from the centre into the area of the thread reserve track. In the following, a nozzle 16 is positioned on the side of the false lap 14 which is distant from the thread reserve track and supplied with adjustable compressed air (see FIG. 7). The nozzle 16 is then moved in the direction of the thread reserve track 15. With the movement of the nozzle 16, the air jet moves the false lap 14 forward away from itself to the position of the thread reserve track 15. During the displacement, the broken end of the thread is fixed within the false lap. In the end position, the supply of air to the nozzle is stopped and the nozzle is brought back to its starting position. The number of nozzles 16 used corresponds to the winder thread load. If more than one nozzle is used, as in the example illustrated here, appropriate means must be employed to ensure that each nozzle is supplied with the same quantity of air. On transition from formation of the thread reserve to normal winding the delivered thread 6 is guided by the guide plate 12 back into the winding area (see FIG. 9). The guide plate 12 is then returned to its inactive position and the thread 6 is transferred to the traversing thread guide 8. Build-up of the bobbin then recommences in the area of the lap 17.

The quality of the method according to the invention is demonstrated by the following examples 1 and 2. A comparison is made between an automatic winder according to EP-A 0 359 453 which operates with formation of a thread reserve according to the German Published Patent Specification 25 24 415 and a winder which operates by the method according to the invention. Both winders are fitted with smooth bobbins, the winder conditions being identical. The continuous filament yarn to be wound in the example is an elastane.

In the evaluation of the change reliability, a change is deemed to be good only if the transition from the full bobbin to the empty bobbin is effected without any problem for all threads on a winder.

In the evaluation of the thread reserve, each bobbin is appraised individually. Two thread ends bound into the lap constitute a negative evaluation.

Examp1e 1

| Yarn characteristics | |
|---|---|
| Total titre | 45 dtex |
| Maximum tensile force elongation | >500% |
| Maximum tensile force | >45 cN |
| Winding rate | >600 m/min. |

| | Change reliability | Thread reserve |
|---|---|---|
| Method according to invention | 100% | 100% |
| Comparison | 96% | 76% |

-continued

Example 2

| Yarn characteristics | |
|---|---|
| Total titre | 17 dtex |
| Maximum tensile force elongation | >450% |
| Maximum tensile force | >20 cN |
| Winding rate | >700 m/min. |

| | Change reliability | Thread reserve |
|---|---|---|
| Method according to invention | 99% | 100% |
| Comparison | 80% | 79% |

We claim:

1. Method for winding continuous threads or yarns (6) through a traversing unit onto bobbins (9), with continuous bobbin change by delivering and winding of the thread (6) onto a bobbin (9) which is in a first position on a revolver driven by a driving roller (2), by traversing of the thread by said traversing unit along the axis of the bobbin until the bobbin is full, separation of the driving roller (2) from the full bobbin (9), at which time driving of the full bobbin is taken over by a separate drive, and further winding of thread (6) onto the full bobbin (9), rotation of the revolver to move the full bobbin out of its first position and into a second position with simultaneous rotation of a separately driven empty bobbin (18), which is also mounted on said revolver towards said first position of said full bobbin until said empty bobbin (18) contacts the drive roller (2) and thread (6), then removing the thread (6) from the traversing unit onto a guide plate (12), braking of the full bobbin (9), and at the same time taking up the running thread (6) onto the empty bobbin (18) thereby causing tension in and breakage of the thread (6) between the empty bobbin (18) and the full bobbin (9), formation of a false lap (14) on the empty bobbin (18), guidance of the delivered thread (6) by the guide plate (12) to one end of the empty bobbin (18) for the purpose of forming a thread reserve (15) at said end and nearly outside the area of the yarn package, displacement of the false lap (14) to said same one end and then removal of the thread (6) from said guide plate onto the traversing unit and continuous winding of thread onto said empty bobbin, said delivered thread being guided by said traversing unit to be wound along the axis of said bobbin, and changing the full bobbin (9) for a new empty bobbin (18).

2. Method according to claim 1, wherein the displacement of said formed false lap (14) is by mechanical or pneumatic means.

3. Method according to claim 2, wherein the displacement of said formed false lap (14) is by means of a fluid which is incident on the empty bobbin (18) at an angle of 0° to 90° relative to the axis of the empty bobbin (18).

4. Method according to claim 2 wherein the formed false lap (14) is displaced by means of a fluid which flows from a fluid nozzle (16) which is capable of lateral movement relative to the axis of the empty bobbin.

5. Method according to claim 4, wherein the fluid used is compressed air.

6. A device for winding continuous threads or yarns onto bobbins, comprising:

a) a rotatable bobbin unit upon which are mounted a plurality of bobbin holders, arranged in series with respect to each other, and upon which bobbins are removably installed, each of said bobbins having a winding area and a thread reserve area being provided with a stop ring (10);

b) a feed mechanism (7) for delivering thread (6) to the bobbins which are installed on the bobbin holders;

c) a traversing thread guide (8), located intermediate the feed mechanism (7) and the rotatable bobbin unit, whereby thread passes from said feed mechanism (7) to said traversing thread guide (8), and from said traversing thread guide (8) to a first bobbin installed on one of said bobbin holders;

d) a guide plate (12) adjacent the traversing thread guide (8), which when activated, lifts the thread off of the thread guide (8) and takes over guidance of the thread;

e) a displaceable axially rotating driving roller (2), which removably engages said first bobbin and, when engaged with said first bobbin, causes it to rotate; and f) a guide unit (16) for moving a false lap transversely along a bobbin;

whereby thread (6) is delivered from said feed mechanism (7), via the traversing thread guide (8) to the first bobbin (9) which is installed on a bobbin holder, said first bobbin (9) being engaged with the displaceable axially rotating driving roller (2), causing first bobbin (9) to rotate whereby said thread (6) is continuously wound upon said first bobbin (9) until said first bobbin (9) becomes full, at which time the driving roller (2) is disengaged from said first bobbin (9) and simultaneously with the disengagement of the driving roller (2) from bobbin (9) the rotation of said first bobbin (9) is taken over by an independent driving unit, so that first bobbin (9) continues to rotate independently of the driving roller (2), the rotatable bobbin unit rotates to rotate first bobbin (9) out of its position and rotate an empty second bobbin (18) into said position thereby coming into contact with thread (6) while said thread (6) continues to be wound upon first bobbin (9) and then the driving roller (2) moves into engagement with the stop ring (10) of said second bobbin (18) causing said second bobbin to rotate at or before the time when said second bobbin begins to rotate the guide plate (12) lifts the thread (6) out of the traversing thread guide (8), and the rotation of first bobbin (9) is braked so that bobbin (6) takes up less thread then is delivered from feed mechanism (7), and the excess is wound upon the second bobbin (18) thereby creating a tensile force between the thread being taken up by the first bobbin (9) and that being wound upon the second bobbin (18) thereby causing the thread (6) to break between the first bobbin (9) and the second bobbin (18), whereupon the thread (6) winds only upon the second bobbin (18), forming the false lap (14) on the second bobbin (18), and the independent driving unit causing the first bobbin (9) to rotate is switched off; the guide plate (12) then is moved parallel to the second bobbin (18) causing thread (6) to be wound upon said second bobbin (18) and guiding said thread (6) to be wound upon the thread reserve area (15) at one end said second bobbin (18), the guide unit (16) then displaces the false lap (14) to the thread reserve area (15); the guide plate (12) then guides thread (6) to the winding area of the second bobbin (18), after which guidance of thread (6) is transferred from the guide plate (12) to the thread guide (8).

7. Device according to claim 6, wherein the guide unit (16) is constructed as a fluid nozzle with a fluid jet angle of 0° to 90° relative to the axis of the empty bobbin (18).

8. Device according to claim 7, wherein the fluid nozzle is laterally displaceable relative to the axis of the empty bobbin.

9. Device according to claim 6, wherein the angle of the fluid jet from the fluid nozzle is 45° relative to the axis of the empty bobbin.

10. Device according to claim 6, wherein the guide unit (16) is a mechanical slide which is laterally movable relative to the axis of the empty bobbin and in the direction of the axis of the empty bobbin.

11. Device according to claim 6, wherein the drive roller (2) and the bobbin holders (3, 4) are each equipped with a separate drive.

* * * * *